US005642556A

United States Patent [19]

Alexander

[11] Patent Number: 5,642,556

[45] Date of Patent: Jul. 1, 1997

[54] DETACHABLE BELTLOOP CONCHOS

[76] Inventor: Steve Alexander, 1250 Rusty La., Las Cruces, N.Mex. 88005

[21] Appl. No.: 640,151

[22] Filed: Apr. 30, 1996

[51] Int. Cl.[6] ..... A44B 11/00

[52] U.S. Cl. ..... 24/163 K; 24/130; 24/189; 24/545

[58] Field of Search ..... 24/171, 163 K, 24/164, 196, 190, 189, 130, 131 C, 545, 543

[56] References Cited

U.S. PATENT DOCUMENTS

| | | | |
|---|---|---|---|
| 391,103 | 10/1888 | Whittemore | 24/196 |
| 676,475 | 6/1901 | Scheuer | 24/189 |
| 965,425 | 7/1910 | Warren | 24/164 |
| 986,014 | 3/1911 | Krenzke | 24/130 |
| 1,326,158 | 12/1919 | Johnson | 24/164 |
| 1,608,662 | 11/1926 | Nourse | 24/130 |
| 2,750,643 | 6/1956 | Rubin | 24/164 |
| 3,465,391 | 9/1969 | Armstrong | 24/130 |
| 3,981,124 | 9/1976 | Kibler | 24/164 |
| 4,377,939 | 3/1983 | Reinsdorf | 24/163 K |
| 4,562,620 | 1/1986 | Oliver, Jr. | 24/163 K |

*Primary Examiner*—Victor N. Sakran
*Attorney, Agent, or Firm*—Patent & Trademark Services; Joseph H. McGlynn

[57] ABSTRACT

A decorative concho that can be attached to the belt loops of a person's pants to provide a different "look". It consists of a decorative buckle which has three bars attached to the back of the buckle. Two of the bars are attached at the ends of the buckle and at one side of the buckle. The other end of the two bars are free. The third bar is attached between the first two bars and is permanently attached at one end to the buckle. The end that is permanently attached is adjacent the free ends of the other two bars to provide a serpentine path between the bars. The concho can be attached to the belt loops by slipping one bar at a time on the belt loop.

1 Claim, 1 Drawing Sheet

FIG. 1
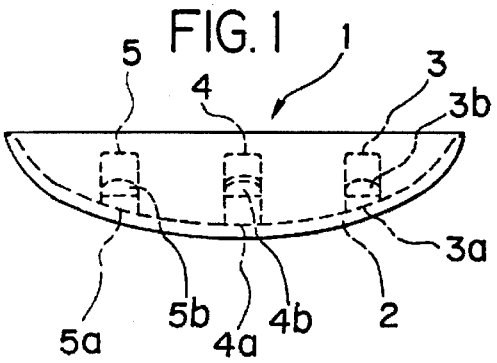
FIG. 2
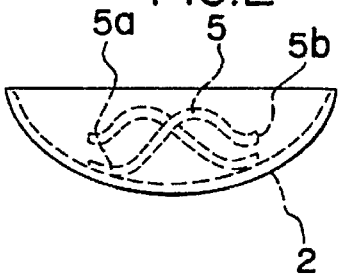
FIG. 3
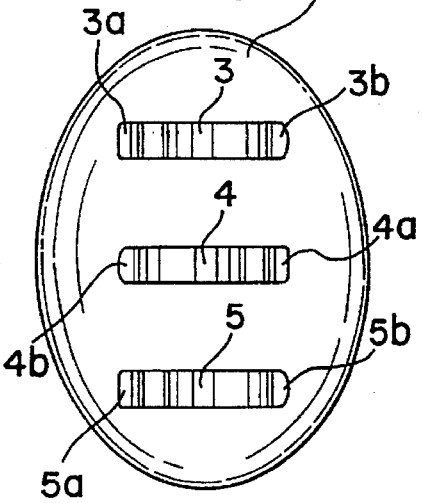
FIG. 4
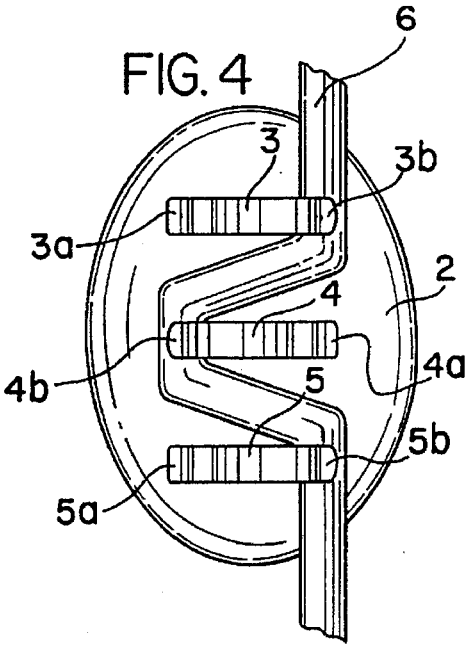
FIG. 5
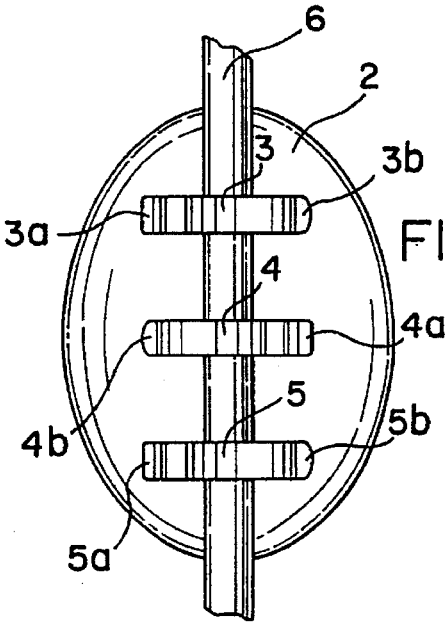
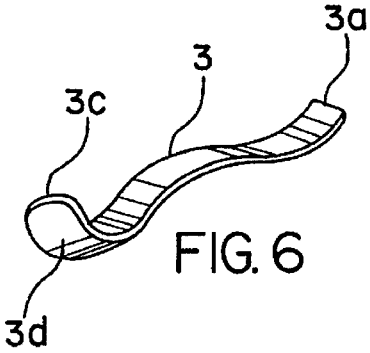
FIG. 6

DETACHABLE BELTLOOP CONCHOS

BACKGROUND OF THE INVENTION

This invention relates, in general, to a decorative concho, and, in particular, to a decorative concho attached to the belt loops of a woman's pants.

DESCRIPTION OF THE PRIOR ART

In the prior art various types of decorative articles for clothing have been proposed. For example, U.S. Pat. No. 965,425 discloses a buckle for securing the ends of straps without employing tongues on the buckles. U.S. Pat. No. 1,326,158 discloses a buckle attached to one end of a strap and having a perpendicular tongue which is placed in a hole on the other end of a strap to secure the ends of the straps. U.S. Pat. No. 2,750,643 discloses a buckle having a spring clip locking structure for securing ends of a strap. U.S. Pat. No. 3,981,124 discloses a concho having top and bottom walls which are slotted to receive and secure the ends of straps.

All of the prior art devices are fixedly secured at one end to the belt or straps. This makes it difficult, or at least inconvenient, to change the device to another belt. Today, people like to mix and match clothing accessories to create a different "look" to their apparel. Utilizing a few clothing accessories in this manner allows them to have many different outfits using the same accessories. This means a savings in money spent on clothing or clothing accessories, and allows a person to dress in a way to match their mood or style.

However, most of the prior art devices make mixing different clothing accessories difficult because of the manner that they are secured to the various articles of clothing. If it is difficult or time consuming to more an accessory from one item of clothing to another, a person will probably not do it. Therefore, there is a need for a decorative clothes accessory that is attractive and easily taken off one item of clothing and placed on another.

SUMMARY OF THE INVENTION

The present invention is directed to a decorative concho that can be attached to the belt loops of a person's pants to provide a different look. It consists of a decorative buckle which has three bars attached to the back of the buckle. Two of the bars are attached at the ends of the buckle and at one side of the buckle. The other end of the two bars are free. The third bar is attached between the first two bars and is permanently attached at one end to the buckle. The end that is permanently attached is adjacent the free ends of the other two bars to provide a serpentine path between the bars. The concho can be attached to the belt loops by slipping one bar at a time on the belt loop.

It is an object of the present invention to provide a decorative concho that is easily attached to an article of clothing.

These and other objects and advantages of the present invention will be fully apparent from the following description, when taken in connection with the annexed drawings.

BRIEF DESCRIPTION OF THE DRAWINGS

FIG. 1 is a cut away side view of the present invention.

FIG. 2 is a cross section view taken from the end of the present invention.

FIG. 3 is a plan view of the back of the present invention.

FIG. 4 is a plan view of the back of the present invention showing the concho being installed on a belt loop.

FIG. 5 is a plan view of the back of the present invention showing the concho fully installed on a belt loop.

FIG. 6 is a perspective view of one of the prongs of the present invention.

DESCRIPTION OF THE PREFERRED EMBODIMENT

Referring now to the drawings in greater detail, FIG. 1 shows a partial cut away view of the decorative concho 1 of the present invention. It consists of a buckle or decorative portion 2 which can be made of any attractive material such as, but not limited to, nickel silver or sterling silver. Attached to the back of the concho 1 are three prongs 3, 4, and 5. Each of the prongs are made from four gauge half round wire having a round top side 3*c* and a flat bottom side 3*d* as shown in FIG. 6. Each of the prongs is approximately 1 inch long an can be made from the same materials as the concho 1. It should be noted that the dimensions and materials are given merely for illustration purposes and it should be understood that other dimensions or material may be used without departing from the scope of the invention.

As shown in FIG. 2, each of the prongs are attached permanently at one end 5*a* to the back of the concho, and the other end 5*b* is spaced away from the back of the concho approximately ¼ an inch. This gap will allow the belt loop 6, shown in FIGS. 4 and 5, to be slipped between the prongs and the back of the concho. Each of the prongs 3, 4, and 5 are permanently attached at one end to the back of the concho. In FIGS. 3–5 the ends 3*a*, 4*a*, and 5*a* are permanently attached to the concho by, for example, soldering, although any conventional attachment means can be used. The other ends of the prongs 3*b*, 4*b*, and 5*b* are free and spaced from the back of the concho.

In order to attach the concho 1 to a belt loop, the loop is first slipped under the free end 3*b*, and then the belt loop is slipped under the free end 4*b*, and then the belt loop is slipped under the free end 5*b*. As can be seen from FIG. 4 the belt loop must take a serpentine path in order to be placed under all three prongs. Once the belt loop is in place as shown in FIG. 5, the concho will be securely fastened to the belt loop, but can be quickly and easily removed if the wearer wants to put it on a different pair of pants or wants to change conchos.

Also, even though the concho 1 of the present invention is show as oval, the shape is not critical and the concho can be made in any shape.

Although the decorative concho and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A decorative ornament adapted to be attached to belt loops on a pair of pants comprising:

a body member having a front, back, sides and ends, said sides and ends forming an area, at least three prongs attached to said back of said body member, all portions of said at least three prongs being positioned within the area defined by said sides and ends, each of said prongs having a first end and a second end, each of said first ends being permanently attached to said back of said body member, two of said prongs having their first ends attached adjacent a first side of said back of said body member, the remaining prong having its first end attached to an opposite side of said back of said body member, each of said second ends of said prongs being free and spaced from said back of said body member.

* * * * *